US007617710B2

(12) United States Patent
Bourgon et al.

(10) Patent No.: US 7,617,710 B2
(45) Date of Patent: Nov. 17, 2009

(54) ROLLER LEVELLER WITH VARIABLE CENTER DISTANCE

(75) Inventors: Jacques-Yves Bourgon, Metz (FR); Dominique Kircher, Talange (FR)

(73) Assignee: Arcelormittal France, Saint Denis (FR)

( * ) Notice: Subject to any disclaimer, the term of this patent is extended or adjusted under 35 U.S.C. 154(b) by 240 days.

(21) Appl. No.: 10/591,912

(22) PCT Filed: Mar. 1, 2005

(86) PCT No.: PCT/FR2005/000482

§ 371 (c)(1),
(2), (4) Date: Jan. 19, 2007

(87) PCT Pub. No.: WO2005/097369

PCT Pub. Date: Oct. 20, 2005

(65) Prior Publication Data

US 2007/0186607 A1 Aug. 16, 2007

(30) Foreign Application Priority Data

Mar. 10, 2004 (FR) ..... 04 02482

(51) Int. Cl.
*B21D 1/02* (2006.01)
*B21D 3/02* (2006.01)
*B21D 3/04* (2006.01)
*B21D 3/05* (2006.01)

(52) U.S. Cl. ..... 72/165; 72/162

(58) Field of Classification Search ..... 72/160–165
See application file for complete search history.

(56) References Cited

U.S. PATENT DOCUMENTS 4,635,458 A * 1/1987 Bradlee ..... 72/165

FOREIGN PATENT DOCUMENTS

FR 2 334 440 7/1977

* cited by examiner

*Primary Examiner*—Dana Ross
*Assistant Examiner*—Stephanie Jennings
(74) *Attorney, Agent, or Firm*—Oblon, Spivak, McClelland, Maier & Neustadt, L.L.P.

(57) ABSTRACT

A tensionless leveller for levelling a metal strip and having an entry and an exit includes n+1 motorized rolls each having a constant radius R. The leveller also includes a lower superposed cassette supporting at least n/2 of the rolls and an upper superposed cassette supporting at least n/2 of the rolls not supported by the lower superposed cassette. The rolls are offset with respect to one another and are placed alternately above and below a path of the strip. An axis of each of the rolls of the lower cassette is separated from an axis of an immediately successive roll of the upper cassette by a center-to-center spacing $E_k$, in which: for k from 2 to 4, $R/E_k=R/E_1$; for k from n−3 to n, $R/E_k=R/E_n$ and $R/E_c<R/E_1$; and for k from 5 to n−1, $R/E_n \leqq R/E_k \leqq R/E_1$, and $R/E_k \geqq R/E_{k+1}$.

9 Claims, 3 Drawing Sheets

ROLLER LEVELLER WITH VARIABLE CENTER DISTANCE

BACKGROUND OF THE INVENTION

I. Field of the Invention

The present invention relates to a tensionless leveller intended for levelling a metal strip and to the levelling method using said leveller.

II. Description of Related Art

A metal strip or plate undergoes various operations, such as hot rolling and cold rolling, which are intended to give it uniform dimensions over its entire length. Thus, in theory a rolled metal strip has at any point a constant thickness and a constant width.

However, the rolling operation is insufficient for obtaining a defect-free strip. This is because it exhibits non-developable flatness defects, such as waviness at the edges or the center, and/or developable defects such as a curl or a crown, that is to say a curvature either along the length or along the width of the strip, respectively.

These flatness defects can be corrected by levelling the strip in a multi-roll leveller. Such a leveller consists of two superposed cassettes each supporting several motor-driven rolls, of constant diameter, offset with respect to one another and placed alternately above and below the path of the strip. This type of leveller is configured, in terms of the number of rolls, the diameter of the rolls, the center-to-center spacing and the setting, so as to achieve satisfactory levelling of the strip, the thickness of which lies within a defined range.

In a conventional leveller, the center-to-center spacings of the rolls are constant and set so that the ratio of the roll diameter to the center-to-center spacing is between about 0.90 and about 0.95. However, in this type of leveller, the levelling forces and moments are large. For the purpose of reducing them, manufacturers have developed levellers in which all of the center-to-center spacings are increased so that the ratio of the diameter to the center-to-center spacing is around 0.70 to 0.80. However, this no longer allows the non-developable defects to be corrected over the entire range of the leveller in terms of strip thickness, and in particular on a thinner strip.

Manufacturers have also proposed retracting some of the rolls, for example going from nine rolls to five. However, when the number of useful rolls is reduced, the degree of plastic deformation within the leveller varies abruptly, and it becomes difficult to bring the developable defects under control.

BRIEF SUMMARY OF THE INVENTION

The object of the present invention is therefore to propose a leveller in which the levelling forces and moments are reduced compared with those of a conventional leveller, while still maintaining good flatness correction over the entire range of the leveller, and by making it easier to bring curl and crown under control.

For this purpose, the subject of the invention is a tensionless leveller intended for levelling a metal strip, having an entry and an exit, comprising n+1 rolls, of the type comprising two superposed cassettes each supporting at least n/2 motorized rolls of constant radius R, offset with respect to one another and placed alternately above and below the path of the strip, the axis of each of the rolls of one cassette being separated from the axis of the immediately successive roll of the other cassette by a center-to-center spacing $E_k$, in which:

for k: 2 to 4, $R/E_k=R/E_1$;

for k: n−3 to n, $R/E_k=R/E_n$ and $R/E_n<R/E_1$; and for k from 5 to n−1, $R/E_n \leqq R/E_k \leqq R/E_1$, and $R/E_k \geqq R/E_{k+1}$, said leveller optionally including means for adjusting the center-to-center spacings $E_k$.

The leveller according to the invention may furthermore have the following features:

$n \geqq 8$;

when the thickness of the strip to be levelled is between 0.5 and 3 mm, $14 \leqq n \leqq 22$;

when the thickness of the strip to be levelled is between 3 and 15 mm, $10 \leqq n \leqq 16$;

for k from 1 to x, $0.90 \leqq R/E_k \leqq 0.95$, and for k from x+1 to n, $0.70 \leqq R/E_k \leqq 0.80$;

for k from 1 to x, $0.90 \leqq R/E_k \leqq 0.95$, one of the center-to-center spacings $E_x$, where $5 \leqq x \leqq n-4$, being such that: $0.80 \leqq R/E_x \leqq 0.90$; and for k from x+1 to n, $0.70 \leqq R/E_k \leqq 0.80$; and for k from 1 to x, $0.90 \leqq R/E_k \leqq 0.95$, one of the center-to-center spacings $E_x$, where $5 \leqq x \leqq n-4$, being such that: $0.80 \leqq R/E_x \leqq 0.90$, and $0.75 \leqq R/E_{x+1} \leqq 0.85$, and for k from x+2 to n, $0.70 \leqq R/E_k \leqq 0.80$.

The subject of the invention is also a method for levelling a metal strip, in particular a steel strip, in which this leveller is used with a degree of plastic deformation of at least 60% and at most 90%.

As will have been understood, the invention consists in proposing a leveller in which at least the first five rolls starting from the entry of the leveller have a radius/center-to-center spacing ratio identical to that of conventional levellers, in which at least the last five rolls from the entry of the leveller have a radius/center-to-center spacing ratio close to that of a decurler, and in which the center-to-center spacing between the intermediate rolls of the leveller is advantageously increased.

BRIEF DESCRIPTION OF THE DRAWINGS

The features and advantages of the present invention will become more clearly apparent over the course of the following description, given by way of non-limiting example and with reference to the appended drawings in which.

DETAILED DESCRIPTION OF THE INVENTION

Figure 1:
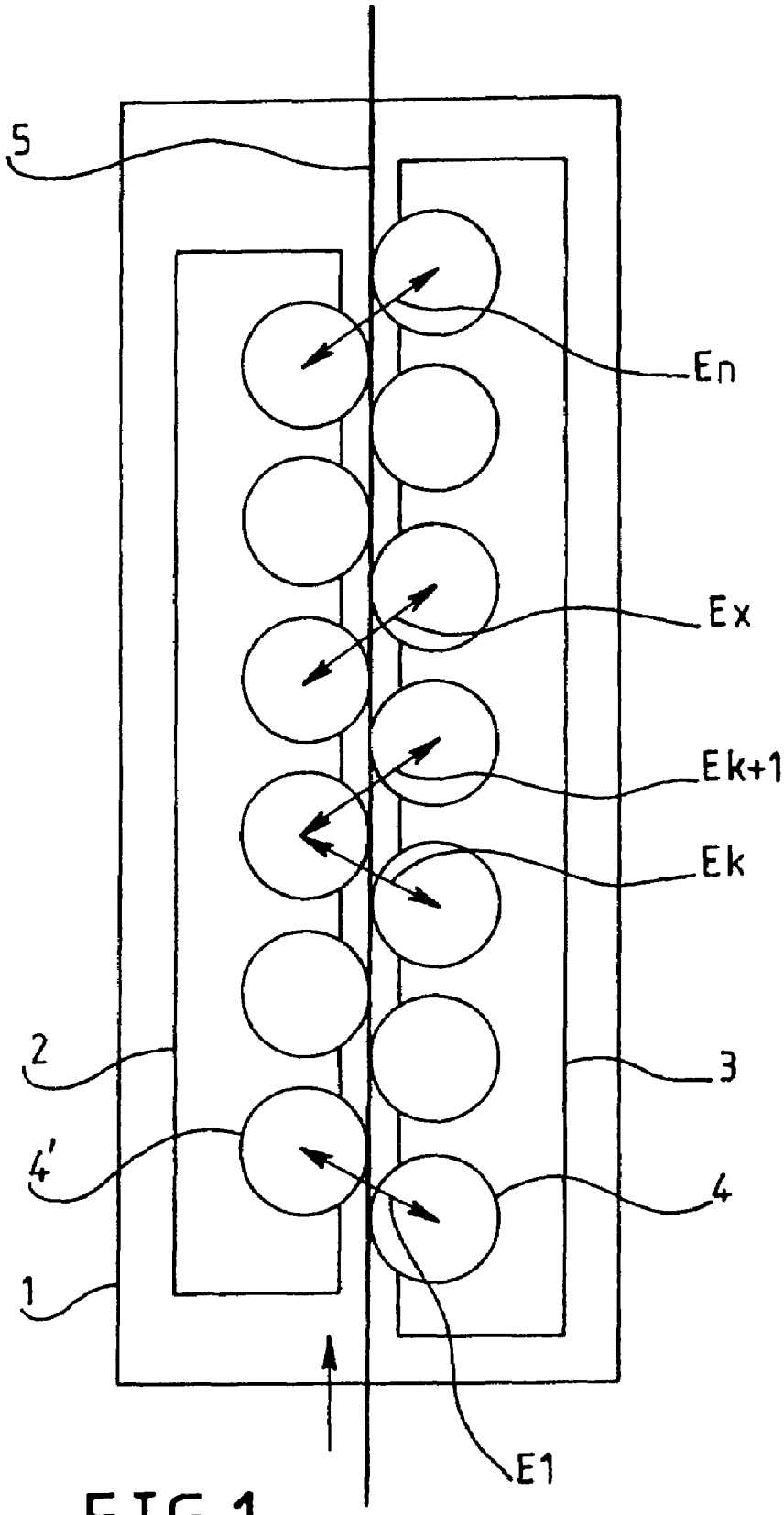
FIG. 1 shows a schematic cross-sectional view of a tensionless multi-roll leveller according to the invention.

FIG. 1 shows schematically a leveller 1 comprising a lower cassette 2 and an upper cassette 3 being two superposed cassettes 2, 3, each supporting motorized rolls 4, 4' of constant radius R. To level a metal strip 5, this strip 5 is made to run between the rolls 4, 4' and a leveller entry, corresponding to the entry of the strip 5 into the leveller 1, and a leveller exit, corresponding to the exit of the strip 5 from the leveller 1, are thus defined. The rolls 4, 4' are positioned so as to be offset one with respect to another and placed alternately above and below the path of the metal strip 5. To obtain correct levelling of the strip 5, each cassette 2, 3 must support at least n/2 rolls 4, 4' and, more precisely, for a leveller 1 comprising n+1 rolls 4, 4', the lower cassette 2 comprises (n/2)+1 rolls 4 and the upper cassette 3 comprises n/2 rolls 4'. The axis of each of the rolls 4, 4' of a given cassette 2, 3 is separated from the axis of the immediately successive roll 4, 4' of the other cassette by a center-to-center spacing $E_k$, which can be varied.

To obtain a levelled strip 5 with a zero curl, it is necessary to set the gap between the rolls 4 of the lower cassette 2 and the rolls 4' of the upper cassette 3 located on the exit side of the leveller 1, that is to say to set the entry clamping and exit clamping of the leveller 1. To adapt the setting according to the type of strip 5 to be levelled, the center-to-center spacing $E_k$ may be varied using adjustment means (not shown).

The inventors have demonstrated by reducing the radius/center-to-center spacing ratio of the rolls down to a value of around 0.8, starting from the fifth roll from the entry of the leveller, in a leveller whose radius/center-to-center spacing ratio between at least the first five rolls from the entry of the leveller corresponds to the radius/center-to-center spacing ratio of a conventional leveller, the levelling forces and moments can be reduced by 5 to 25% depending on the type of adjustment made.

Thus, for the first five rolls from the entry of the leveller, that is to say when k varies from 2 to 4, the $R/E_k$ ratio is equal to the ratio $R/E_1$, in which $E_1$ corresponds to the center-to-center spacing between the first roll from the entry of the leveller and the second roll from the entry of the leveller, $R/E_1$ being between 0.90 and 0.95, limits inclusive, which values correspond to the radius/center-to-center spacing ratio of a conventional leveller.

For the last five rolls from the entry of the leveller, that is to say when k varies from n−3 to n, the $R/E_k$ ratio is equal to the ratio $R/E_n$, in which $E_n$ corresponds to the center-to-center spacing between the last roll from the entry of the leveller and the penultimate roll from the entry of the leveller, $R/E_n$ being between 0.70 and 0.80, limits inclusive, which values correspond to the radius/center-to-center spacing ratio of a conventional decurler.

Thus, in the leveller according to the invention, it is clear that the ratio $R/E_1$ is always greater than the ratio $R/E_n$. Furthermore, it is also recommended that, between the fifth roll from the entry and the (n−1)th roll from the entry of the leveller, that is to say when k varies from 5 to n−1, the following relationships are satisfied:

$$R/E_n \leqq R/E_k \leqq R/E_1, \text{ and } R/E_k \geqq R/E_{k+1},$$

These conditions make it possible to reduce the forces exerted on the rolls and to reduce the moment needed for levelling. Thus, for an equivalent results in terms of levelling, the power of the leveller according to the invention will be 15 to 20% less than the power of a conventional leveller.

Furthermore, the inventors have observed an increase in the number of operating points using a leveller according to the invention, compared with a conventional leveller having the same number of rolls. The number of operating points of a leveller is determined by the adjustment to be made to the leveller in order to obtain, on leaving the leveller, a strip having a zero curl and a zero crown. Thus, the larger the number of operating points for a given leveller, the lower the constraint as regards the adjustments. This therefore represents an additional advantage, since the time required to adjust the leveller according to the invention will be able to be reduced.

In order for the non-developable flatness defects of the strip to be properly corrected, it is essential for the $R/E_k$ ratio to be equal to the $R/E_1$ ratio, to within the accuracy of setting the center-to-center spacing between the rolls, for at least the first five rolls from the entry of the leveller.

Preferably, the leveller comprises more than nine rolls, that is to say n is equal to or greater than 8, in order for both non-developable defects and developable defects to be properly corrected. This is because, with fewer than nine rolls, it becomes difficult to bring the developable defects under control, and the metal strip may retain a residual crown and a residual curl.

Advantageously, to make the adjustments easier and to properly correct all the flatness defects of a metal strip within a thickness range from 0.7 to 3 mm, the leveller comprises between 15 and 23 rolls (limits inclusive), i.e. $14 \leqq n \leqq 22$.

When the metal strip has a thickness range between 3 and 15 mm, the leveller advantageously comprises between 11 and 17 rolls, i.e. $10 \leqq n \leqq 16$.

Depending on the quality of resolution of the flatness defects and the desired reduction in levelling force and moment, the inventors have developed various types of leveller, which we will now describe.

According to a first embodiment of the invention, the leveller is divided into two zones. A first zone is thus between the first roll from the entry of the leveller and the (x+1)th roll from the entry of the leveller, that is to say when k varies from 1 to x, and extends at least as far as the fifth roll from the entry of the leveller. In this first zone, the radius/center-to-center spacing ratio $R/E_k$ is constant and between 0.90 and 0.95 (limits inclusive). The second zone lies between the (x+1)th roll from the entry of the leveller and the last roll from the entry of the leveller, which is the (n+1)th roll, that is to say when k varies from x+1 to n, and starts at least from the (n−3)th roll from the entry of the leveller. In this zone, the radius/center-to-center spacing ratio $R/E_k$ is constant and between 0.70 and 0.80 (limits inclusive).

According to a second embodiment of the invention, the leveller is divided into three zones. A first zone lies, as in the first embodiment, between the first roll from the entry of the leveller and the (x+1)th roll from the entry of the leveller, that is to say when k varies from 1 to x, and extends at least as far as the fifth roll from the entry of the leveller. In this zone, the radius/center-to-center spacing ratio $R/E_k$ is constant and between 0.90 and 0.95 (limits inclusive). Next, a second zone in which one of the radius/center-to-center spacing ratios, which will be called $R/E_x$, is between 0.80 and 0.90 (limits inclusive). This second zone lies between the fifth roll from the entry of the leveller and the (n−4)th roll from the entry of the leveller, that is to say when x varies from 5 to n−4. Finally, a third zone lies between the (x+1)th roll from the entry and the last roll of the leveller (the (n+1)th roll), that is to say when k varies from x+1 to n. In this third zone, the radius/center-to-center spacing ratio $R/E_k$ is constant and between 0.70 and 0.80 (limits inclusive).

In a third embodiment of the invention, the leveller is again divided into three zones. A first zone lies, as in the previous embodiments, between the first roll from the entry of the leveller and the (x+1)th roll from the entry of the leveller, that is to say when k varies from 1 to x, and extends at least as far as the fifth roll from the entry of the leveller. In this zone, the radius/center-to-center spacing ratio $R/E_k$ is between 0.90 and 0.95 (limits inclusive). Next, a second zone in which one of the radius/center-to-center spacing ratios, which will be called $R/E_x$ is between 0.80 and 0.90 (limits inclusive) and the radius/center-to-center spacing ratio $R/E_{x+1}$ is between 0.75 and 0.85 (limits inclusive). This second zone lies between the fifth roll from the entry of the leveller and the (n−4)th roll from the entry of the leveller, that is to say when x varies from 5 to n−4. Finally, a third zone lies between the (x+2)th roll from the entry of the leveller and the last roll of the leveller (the (n+1)th roll), that is to say when k varies from x+2 to n. In this third zone, the radius/center-to-center spacing ratio $R/E_k$ is constant and between 0.70 and 0.80 (limits inclusive).

In a third embodiment of the invention, the leveller is again divided into three zones. A first zone lies, as in the previous embodiments, between the first roll from the entry of the leveller and the (x+1)th roll from the entry of the leveller, that is to say when k varies from 1 to x, and extends at least as far as the fifth roll from the entry of the leveller. In this zone, the radius/centre-to-centre spacing ratio $R/E_k$ is between 0.90 and 0.95 (limits inclusive). Next, a second zone in which one of the radius/centre-to-centre spacing ratios, which will be called $R/E_x$ is between 0.80 and 0.90 (limits inclusive) and the radius/centre-to-centre spacing ratio $R/E_{x+1}$ is between 0.75 and 0.85 (limits inclusive). This second zone lies between the fifth roll from the entry of the leveller and the (n−4)th roll from the entry of the leveller, that is to say when x varies from 5 to n−4. Finally, a third zone lies between the (x+2)th roll from the entry of the leveller and the last roll of the leveller (the (n+1)th roll), that is to say when k varies from x+2 to n. In this third zone, the radius/centre-to-centre spacing ratio $R/E_k$ is constant and between 0.70 and 0.80 (limits inclusive).

The invention also relates to a method for levelling a metal strip, in which one of the levellers described above is used with a degree of plastic deformation of at least 60% but at most 90%.

The degree of plastic deformation of a metal strip is defined as being the thickness of the plastically deformed metal strip to the total thickness.

Thus, if the degree of plastic deformation is less than 60%, it is no longer possible to remedy the flatness defects of the strip. However, if this degree of plastic deformation is greater than 90%, the metal strip becomes difficult to level and in this case it is also difficult to remedy the flatness defects of the strip.

The metal strip to be levelled may be made of steel, either carbon steel or stainless steel, coated with a metal coating, for example based on zinc, or with an organic coating.

The invention will now be illustrated by examples given by way of non-limiting indication.

A conventional leveller, denoted by leveller X, comprising (k+1) rolls with k equal to 16, i.e. seventeen rolls, with a diameter of 57 mm and a constant center-to-center spacing $E_k$ of 30 mm (a leveller of the BRONX type), therefore having a constant radius/center-to-center spacing ratio $R/E_k$ of 0.95, was modified in order to obtain various levellers according to the invention, namely:

Leveller A: for k from 1 to 4, $R/E_k$=0.95 and
for k from 5 to 16, $R/E_k$=0.80;
Leveller B: for k from 1 to 4, $R/E_k$=0.95,
for k=5, $R/E_k$=0.865 and
for k from 6 to 16, $R/E_k$=0.80; and
Leveller C: for k from 1 to 4, $R/E_k$=0.95,
for k=5, $R/E_k$=0.90, and $R/E_{k+1}$=0.85, and
for k from 7 to 16, $R/E_k$=0.80.

A steel strip 2 mm in thickness and 1000 mm in width was then made to run through each of these levellers A, B, C and X, applying either a degree of plastic deformation of 60% or 80%. The steel in question was a steel of the THR1000 type, the yield strength $R_{p0.2}$ of which was 900 MPa.

Figure 2:
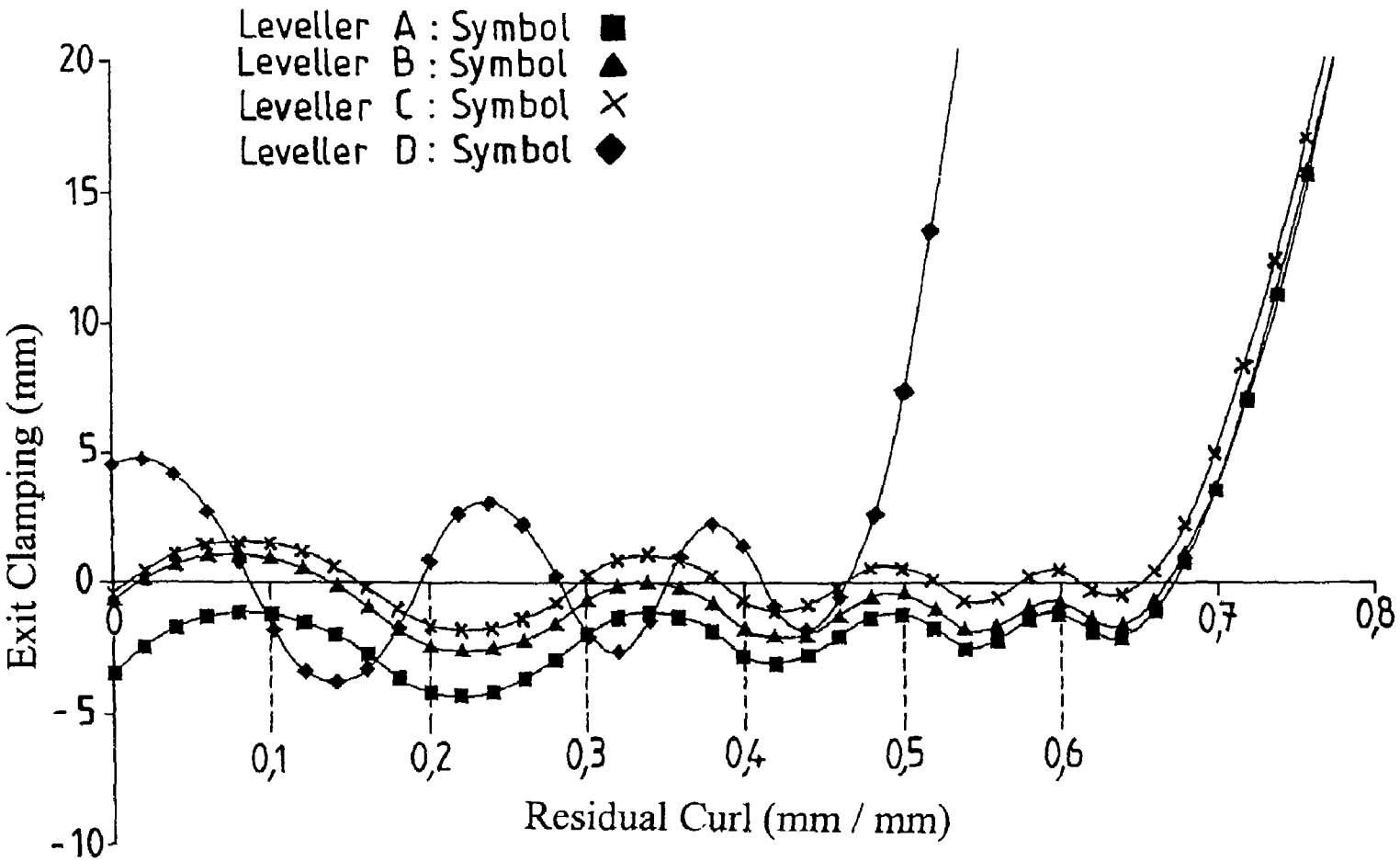
FIG. 2 shows a calculation curve of the residual curl of a levelled metal strip as a function of the exit clamping of the leveller, for a degree of plastic deformation of 60%.
Figure 3:
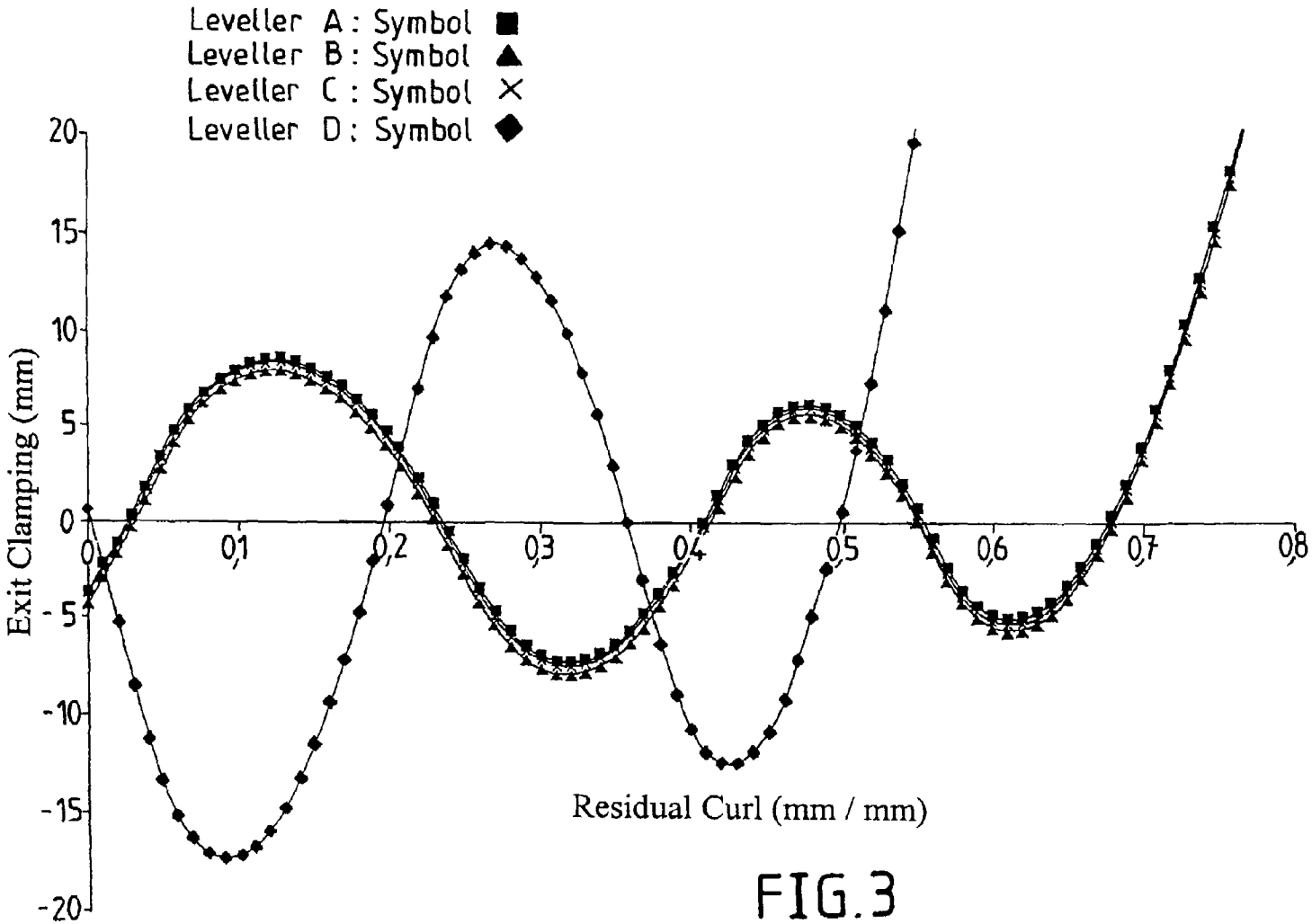
FIG. 3 shows a calculation curve of the residual curl of a levelled metal strip as a function of the exit clamping of the leveller, for a degree of plastic deformation of 80%.

FIGS. 2 and 3 show a calculation curve of the residual curl of the levelled steel strip as a function of the exit clamping of the leveller for a degree of plastic deformation of 60% (FIG. 2) and for a degree of plastic deformation of 80% (FIG. 3).

The various levellers are identified by the following symbols:

leveller A: symbol ■,
leveller B: symbol ▲,
leveller C: symbol X, and
leveller X: symbol ◆.

Finally, the leveller entry forces, the leveller exit forces, the total forces and the moment of the leveller were measured for each leveller and for each degree of plastic deformation. The reductions obtained in each of the levellers A, B and C according to the invention compared with the conventional leveller X were calculated and all of the results are given in Tables 1 and 2.

TABLE 1 reduction in forces and moment, and increase in number of operating points, for a 60% degree of plastic deformation

| | Force reduction at leveller entry (%) | Force reduction at leveller exit (%) | Total force reduction (%) | Total moment reduction of the leveller (%) | Number of operating points |
|---|---|---|---|---|---|
| Leveller A | 23 | 11 | 17 | 35 | 1 |
| Leveller B | 18 | 14 | 15 | 31 | 3 |
| Leveller C | 15 | 14 | 14 | 25 | 9 |
| Leveller X | — | — | — | — | 6 |

TABLE 2 reduction in forces and moment, and increase in number of operating points, for a 80% degree of plastic deformation

| | Force reduction at leveller entry (%) | Force reduction at leveller exit (%) | Total force reduction (%) | Total moment reduction of the leveller (%) | Number of operating points |
|---|---|---|---|---|---|
| Leveller A | 23 | 8 | 16 | 27 | 5 |
| Leveller B | 17 | 11 | 14 | 24 | 5 |
| Leveller C | 15 | 13 | 14 | 22 | 5 |
| Leveller X | — | — | — | — | 4 |

It is apparent from these two tables of results that leveller A is the leveller allowing the largest reductions in force and moment to be obtained, irrespective of the degree of plastic deformation. However, as may be seen in FIGS. 2 and 3, this leveller is not necessarily the most reliable if it is desired to give the metal strip a perfectly zero curl, since, in particular when the degree of plastic deformation is 60%, the number of operating points is 1, whereas it is 9 in the case of leveller C.

The invention claimed is:

1. A tensionless leveller for levelling a metal strip and having an entry and an exit, comprising:

n+1 motorized rolls each having a constant radius R;

a lower superposed cassette supporting at least n/2 of the rolls; and an upper superposed cassette supporting at least n/2 of the rolls not supported by the lower superposed cassette; wherein the rolls are offset with respect to one another and are placed alternately above and below a path of the strip, an axis of each of the rolls of one of the lower or the upper cassette being separated from an axis of an immediately successive roll of the other of the lower or the upper cassette by a center-to-center spacing $E_k$, in which:

for k from 2 to 4, $R/E_k=R/E_1$;

for k from n−3 to n, $R/E_k=R/E_n$ and $R/E_n<R/E_1$; and for k from 5 to n−1, $R/E_n \leqq R/E_k \leqq R/E_1$, and $R/E_k \geqq R/E_{k+1}$, a center-to-center spacing between a first roll of the rolls from the entry of the leveller and a second roll of the rolls from the entry of the leveller being $E_1$, and a center-to-center spacing between a last roll of the rolls from the entry of the leveller and a next to last roll of the rolls from the entry of the leveller being $E_n$.

2. The leveller according to claim 1, in which $n \geqq 8$.

3. The leveller according to claim 1, wherein, when a thickness of the strip to be levelled is between 0.5 and 3 mm $14 \leqq n \leqq 22$.

4. The leveller according to claim 1, wherein, when a thickness of the strip is between 3 and 15 mm, $10 \leqq n \leqq 16$.

5. The leveller according to claim 1, wherein:

for k from 1 to x, $0.90 \leqq R/E_k \leqq 0.95$; and for k from x+1 to n, $0.70 \leqq R/E_k \leqq 0.80$.

6. The leveller according to claim 1, wherein:

for k from 1 to x, $0.90 \leqq R/E_k \leqq 0.95$;

for one of the center-to-center spacings $E_x$, where $5 \leqq x \leqq n-4$, $0.80 \leqq R/E_x \leqq 0.90$; and for k from x+1 to n, $0.70 \leqq R/E_k \leqq 0.80$.

7. The leveller according to claim 1, wherein:

for k from 1 to x, $0.90 \leqq R/E_k \leqq 0.95$;

for one of the center-to-center spacings $E_x$, where $5 \leqq x \leqq n-4$, $0.80 \leqq R/E_x \leqq 0.90$, and $0.75 \leqq R/E_{x+1} \leqq 0.85$; and for k from x+2 to n, $0.70 \leqq R/E_k \leqq 0.80$.

8. A method of levelling a metal strip in which a leveller according to any one of claims 1 to 7 is used, wherein a degree of plastic deformation applied by the leveller is at least 60% and at most 90%.

9. The levelling method according to claim 8, wherein the metal strip is a steel strip.

* * * * *